US007156510B2

(12) United States Patent
Hilton et al.

(10) Patent No.: US 7,156,510 B2
(45) Date of Patent: Jan. 2, 2007

(54) DEVICES FOR DISSIPATING HEAT IN A FLUID EJECTOR HEAD AND METHODS FOR MAKING SUCH DEVICES

(75) Inventors: Brian S. Hilton, Rochester, NY (US); Eric A. Merz, Palmyra, NY (US)

(73) Assignee: Fuji Xerox Co., Ltd., Tokyo (JP)

( * ) Notice: Subject to any disclaimer, the term of this patent is extended or adjusted under 35 U.S.C. 154(b) by 214 days.

(21) Appl. No.: 10/629,606

(22) Filed: Jul. 30, 2003

(65) Prior Publication Data

US 2005/0024457 A1 Feb. 3, 2005

(51) Int. Cl.
*B41J 2/175* (2006.01)

(52) U.S. Cl. ..... 347/86

(58) Field of Classification Search ..... 347/84, 347/85, 86, 87, 13, 42, 65, 40, 43; 210/27
See application file for complete search history.

(56) References Cited

U.S. PATENT DOCUMENTS 5,801,727 A * 9/1998 Torpey ..... 347/40
6,183,076 B1 2/2001 Childers et al.
6,378,994 B1 4/2002 Ueda et al.
2002/0033861 A1 * 3/2002 Boyd et al. ..... 347/42

FOREIGN PATENT DOCUMENTS

EP 1 078 769 A2 2/2001

OTHER PUBLICATIONS

Selected pages from Cool Polymers, Inc. Website (www.coolpolymers.com), Mar. 3, 2003, including product descriptive pages directed to Cool Poly® E2 Series Thermally Conductive Liquid Crystalline Polymer, Processing Guidelines and Application Reviews.

* cited by examiner

*Primary Examiner*—Lamson Nguyen
(74) *Attorney, Agent, or Firm*—Oliff & Berridge, PLC

(57) ABSTRACT

A print cartridge includes a manifold that is molded from a polymer including at least one thermally conductive filler material, and a fluid ejector die module attached to the manifold. A method of manufacturing a print cartridge includes molding a manifold at least partially from a polymer including thermally conductive fillers, forming a fluid ejector die module, and attaching the manifold to the fluid ejector die.

19 Claims, 18 Drawing Sheets

DEVICES FOR DISSIPATING HEAT IN A FLUID EJECTOR HEAD AND METHODS FOR MAKING SUCH DEVICES

BACKGROUND OF THE INVENTION

1. Field of Invention

This invention is directed to devices and methods for dissipating heat in fluid ejector heads.

2. Description of Related Art

A variety of devices and methods are conventionally used to dissipate heat in a thermal fluid ejector head. The thermal fluid ejector heads of fluid ejection devices, such as, for example ink jet printers, generate significant amounts of residual heat as the fluid is ejected by heating the fluid to the point of vaporization. This residual heat will change the performance and ultimately the ejection quality if the heat remains within the fluid ejector head. The ejector performance is usually seen by a change in the drop size, firing frequency, or other ejection metrics. Such ejection metrics are required to stay within a controllable range to have acceptable ejection quality. During lengthy operation or heavy coverage ejection, the temperature of the fluid ejector head can exceed an allowable temperature limit. Once the temperature limit has been exceeded, a slow down or cool down period is required to maintain the ejection quality.

Many fluid ejection devices, such as, for example, printers, copiers and the like, improve throughput by improving thermal performance. One technique to improve fluid ejector head performance is to divert excess heat into the fluid being ejected. Once the fluid being ejected has exceeded a predetermined temperature, the hot fluid is ejected from the fluid ejector head. During lengthy operation or during heavy area coverage ejection, this technique is also susceptible to temperatures in the fluid ejector head exceeding the maximum allowable temperature.

Another technique is to use a heat sink to store or conduct heat away from the fluid ejector head. Typically, these heat sinks are made from copper, aluminum or other materials having high thermal conductivity to remove heat from the fluid ejector head.

When such materials are used, however, the heat sink adds additional weight, size, cost and energy usage to the fluid ejector head, especially for fluid ejector heads that are translated past the receiving medium. Additionally, many fluids, such as inks, use solvents and/or salts which are likely to corrode aluminum or copper.

The heat sinks are typically bonded to a substrate. The substrate materials are often made from a conductive metal, such as aluminum or copper, that conducts heat away from a die module of the fluid ejector head. However, some fluid ejection devices use a plastic substrate that has a relatively low thermal conductivity. When metal heat sinks are used, the bond between the substrate and the die is subjected to significant stress due to temperature changes. The stress is generated from the large mismatch between the coefficients of thermal expansions of the substrate and the die.

These stresses create delaminating problems, where the die separates from the substrate, or the layers of the die separate. Also, the stress presents additional fluid ejection quality and reliability issues.

SUMMARY OF THE INVENTION

This invention provides systems and methods for dissipating heat in a fluid ejector head.

This invention separately provides devices and methods for obtaining better thermal conductivity in a manifold made from a polymer.

In various exemplary embodiments of the devices and methods of this invention, a manifold molded from a polymer having at least one thermally conductive filler material is used to cool the fluid ejector head assembly. In various exemplary embodiments of the devices and methods of this invention, a manifold and fluid ejector die are made of materials having similar coefficients of thermal expansion. In various exemplary embodiments of the devices and methods of this invention, a manifold and container are integrally molded into a single piece. In various exemplary embodiments of the devices and methods of this invention, the at least one filler material is oriented substantially parallel to an oriented flow area of the fluid ejector die module.

These and other features and advantages of the this invention are described in, or apparent from, the following detailed descriptions of various exemplary embodiments of the systems and methods according to this invention.

BRIEF DESCRIPTION OF THE DRAWINGS

Various exemplary embodiments of the invention will be described in detail with reference to the following figures, wherein.

DETAILED DESCRIPTION OF EXEMPLARY EMBODIMENTS

Figure 1:
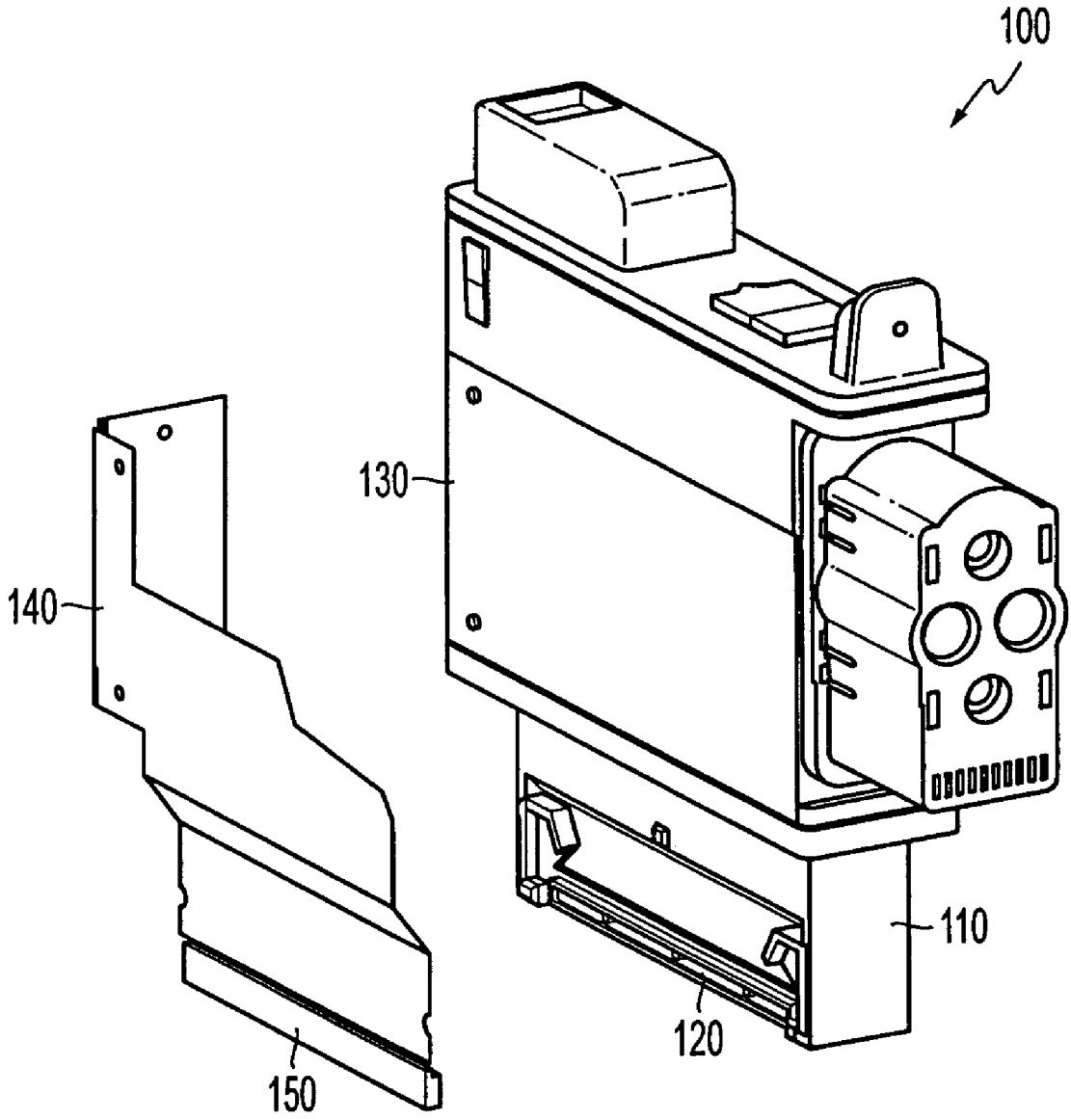
FIG. 1 is a block diagram illustrating a first exemplary embodiment of a fluid ejector element usable with various exemplary embodiments of the systems and methods according to this invention.

The following detailed description of various exemplary embodiments of the fluid ejection systems according to this invention may refer to and/or illustrate one specific type of fluid ejection system, an ink jet printer, for sake of clarity and familiarity. However, it should be appreciated that the principles of this invention, as outlined and/or discussed below, can be equally applied to any known or later developed fluid ejection systems, beyond the ink jet printer specifically discussed herein.

Various exemplary embodiments of the systems and methods according to this invention enable the dissipation of heat from fluid ejector heads, such as, for example, thermal ink jet printers, copiers and/or facsimile machines, by using a polymer mixed with one or more thermally conductive filler materials. In various exemplary embodiments, the device and techniques according to this invention provide manifolds formed using a polymer material, having one or more filler materials, with properties that allow the polymer manifolds to more readily dissipate heat, while the polymer manifold, as a whole, has a coefficient of thermal expansion that is similar to that of the die of the thermal fluid ejector head.

In various exemplary embodiments, the manifold according to this invention is manufactured using a highly thermally-conductive polymer. The highly thermally-conductive polymer has thermal conductivities in the range of about 10 W/m° C. to about 100 W/m° C. This thermal conductivity is typically about 50–500 times greater than that of standard plastics, which ranges from 0.1–0.3 W/m° C. The highly conductive polymer has a thermal conductivity which is close to the thermal conductivity of aluminum. The thermal conductivity of aluminum is about 100–150 W/m° C. These polymers may also be easily injection molded into shapes that tend to maximize the surface area, and thus the heat dissipation rate, of the manifold.

The manifold is used to carry heat away from a die of a thermal fluid ejection head, allowing the fluid ejector head to operate for extended periods of time. Operating a fluid ejector head for extended periods of time typically increases the temperatures in the die of the fluid ejector head. Dissipating the heat away from the die allows the fluid ejector head to operate at temperatures cool enough to enable high quality fluid ejection.

In various exemplary embodiments according to this invention, the highly conductive polymers used for the manifold material includes base polymers mixed with a variety of filler materials. For example, one such polymer material is COOL POLY™ made by Cool Polymers Inc. Specifically, the COOL POLY E200™ polymer material is an injection-moldable, liquid-crystal-polymer-based material having a thermal conductivity of about 60 W/m° C. and a coefficient of thermal expansion (parallel to flow) of about 5 μm/m per degree C.

Recently, other companies, such as Polyone, LDP Engineering Plastics, RTP Company, GE and Dupont, have developed highly conductive polymers that may also be used with the heat sinks according to this invention.

Typical filler materials include graphite fibers and ceramic materials, such as boron nitride and aluminum nitride fibers. In various exemplary embodiments, blends of highly conductive polymers having high thermal conductivity use graphite fibers formed from a petroleum pitch base material. Typical base material for the polymers include liquid crystal polymer (LCP), polyphenylene sulfide and polysulfone.

In various exemplary embodiments, the manifold is bonded to the die of the fluid ejector head. The die of the fluid ejector head is typically made from silicon, which has a coefficient of thermal expansion of about 4.67 μm/m° C.

Table 1 lists various properties for some commonly used substrate materials and for an exemplary highly conductive polymer, i.e, COOL POLY E200™ manufactured by Cool Polymers Inc.

TABLE 1

| Material | Coefficient of Thermal Expansion (μm/m ° C.) | Elastic Modulus (GPa) | Shear Force (Calculated[1]) (N) |
|---|---|---|---|
| Aluminum | 23 | 70 | 2.14 |
| Copper | 11.7 | 110 | 1.18 |
| Noryl | 72 | 2.4 | 0.32 |
| CoolPoly E200 (parallel to flow direction) | 5 | 60 | 0.033 |
| CoolPoly E200 (perpendicular to flow) | 15 | 60 | 1.06 |

[1]The calculated shear force in Table 1 assumes a 3 mm × 1 mm × 25 mm silicon die bonded to 5 mm thick substrate for a 30° C. temperature change.

The calculated shear force F between the die and the heat sink material is determined as:

$$F=[(\alpha_s-\alpha_d)\Delta T]/[(1/E_S A_S)+(1/E_d A_d)],$$

where:

$\alpha_S$ is the thermal expansion coefficient of the substrate;

$\alpha_d$ is the thermal expansion coefficient of the die module, which is 4.67 um/m° C. for dies formed of silicon;

$E_S$ is the elastic modulus of the substrate;

$E_d$ is the elastic modulus of the die, which is 70 GPa for dies formed of silicon;

$A_S$ is the cross-sectional area of the substrate; and $A_d$ is the cross-sectional area of the die.

As shown in Table 1, when the one or more thermally conductive filler materials are oriented parallel to the flow direction in a mold, the coefficient of thermal expansion of the polymer/filler material mixture is 5 μm/m° C. When the thermally conductive filler materials are oriented in the polymer perpendicular to the flow, the coefficient of thermal expansion of the polymer/filler material mixture is 15 μm/m° C. By orienting the thermally conductive materials parallel to the flow direction, the coefficient of thermal expansion more effectively matches the coefficient of thermal expansion of the material used to make the die module. Thus, a significant reduction in the shear force is obtained and more effective bonding is achieved.

FIG. 1 illustrates a first exemplary embodiment of a fluid ejector element or head 100 including a structure usable to dissipate heat from the thermal fluid ejector head 100. As shown in FIG. 1, the fluid ejector element 100 includes a thermally conductive manifold 110, fluid outlet ports 120, a fluid supply cartridge or tank 130, a printed wiring member 140 and a thermal fluid ejector die module 150.

In various exemplary embodiments, the thermal fluid ejector die module 150 is attached to the printed wiring member 140. The thermal fluid ejector die module 150 and the printed wiring member 140 are attached to the thermally conductive manifold 110 so that the fluid outlet ports 120 are aligned with fluid inlet channels of the thermal fluid ejector die module 150. The thermally conductive manifold 110 is formed using a molded polymer containing at least one thermally conductive filler material.

In various exemplary embodiments, the printed wiring member 140 includes electrically conductive traces formed on a substrate. The traces have contact pads at one end and contact areas at an opposite end. The contact pads are sized and shaped to be connected to an electrical connector.

Figure 2:
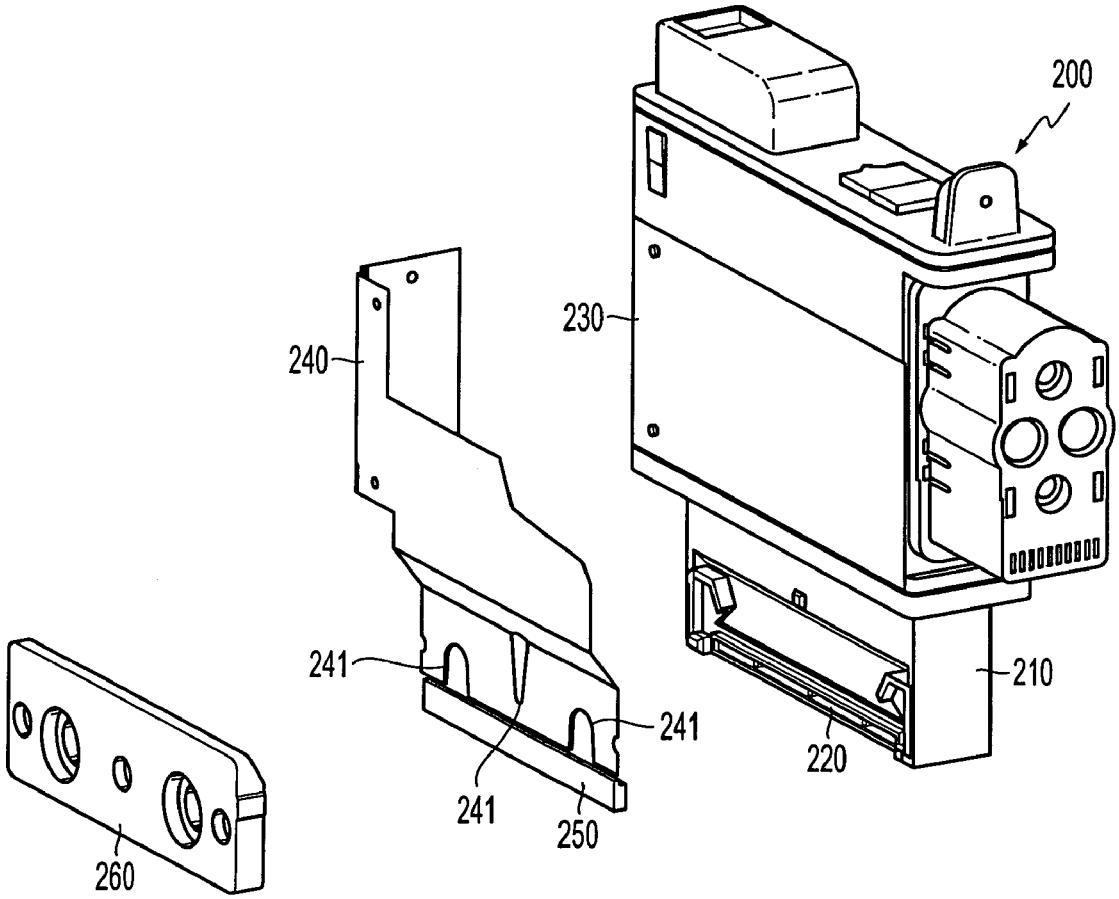
FIG. 2 is a block diagram illustrating a second exemplary embodiment of a fluid ejector element usable with various exemplary embodiments of the systems and methods according to this invention.

FIG. 2 illustrates a second exemplary embodiment of a fluid ejector element or head 200 including a structure usable to dissipate heat from the thermal fluid ejector head 200. As shown in FIG. 2, the fluid ejector element 200 includes a thermally conductive manifold 210, fluid outlet ports 220, a fluid supply cartridge or tank 230, a printed wiring member 240, a thermal fluid ejector die module 250, and a secondary heat sink 260. The secondary heat sink 260 provides additional thermal dissipation when the fluid ejector element requires more thermal dissipation to keep the fluid at a suitable temperature than is provided by the thermally conductive manifold 200.

In various exemplary embodiments, the thermal fluid ejector die module 250 is attached to the printed wiring member 240. The thermal fluid ejector die module 250 and the printed wiring member 240 is attached to the thermally conductive manifold 210 so that the fluid outlet ports 220 are aligned with fluid inlet channels of the thermal fluid ejector die module 250. The thermally conductive manifold 210 is formed using a molded polymer containing at least one thermally conductive filler material.

In various exemplary embodiments, the printed wiring member 240 includes electrically conductive traces on a substrate. The traces have contact pads at one end and contact areas at opposite ends. The contact pads are sized and shaped to be connected to an electrical connector. The printed wiring member 240 also has through-holes 241 that provide fasteners to attach the secondary heat sink 260 to the thermally conductive manifold 210.

Figure 3:
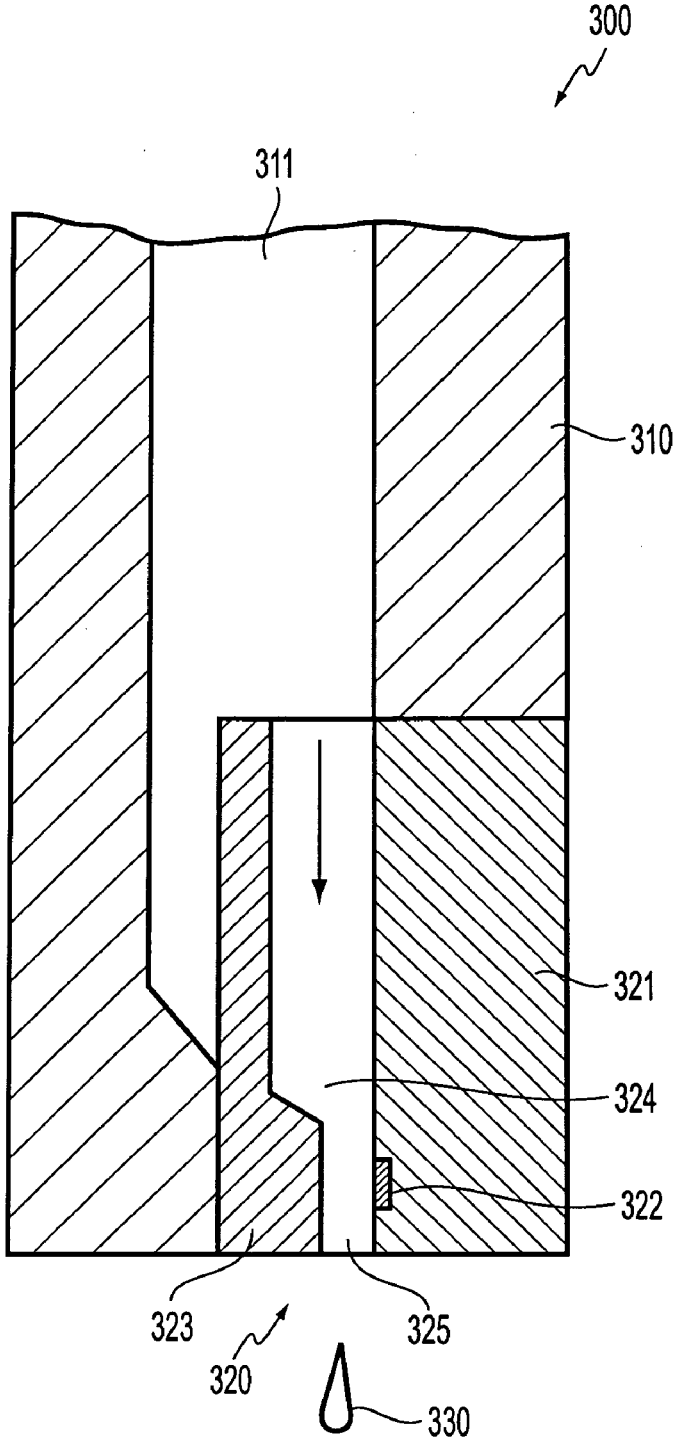
FIG. 3 is a block diagram illustrating a sectional view of a third exemplary embodiment of a fluid ejector element usable with various exemplary embodiments of the systems and methods according to this invention.

FIG. 3 is a cross-sectional view of a third exemplary embodiment of a fluid ejector element or head 300 including a structure usable to dissipate heat from the thermal fluid ejector head 300. As shown in FIG. 3, the fluid ejector element 300 includes a thermally conductive manifold 310 and a thermal fluid ejector die module 320.

In various exemplary embodiments, the thermal fluid ejector die module 320 includes a heating element substrate 321 having a heating element 322 formed on the heating element substrate 321. The heating element substrate 321 is attached to a liquid path substrate 323 to provide a fluid channel 324 and a fluid outlet 325.

In various exemplary embodiments, the heating element substrate 321 and liquid path substrate 323 are registered and bonded, then cut and separated as the thermal fluid ejector die module 320. The thermal fluid ejector die module 320 is attached to the thermally conductive manifold 310. A printed wiring member (not shown) is formed on the thermally conductive manifold 310 to connect the heater element 322 to signal terminals on the thermal fluid ejector die module 320.

In various exemplary embodiments, the thermally conductive manifold 310 includes a chamber 311. Fluid is supplied from a reservoir into the chamber 311 through an inlet. The fluid is then distributed to each of the channels 324. The pressure of bubbles developed in the channels 324 by the heating element 322 heating the fluid in the channel 324 ejects liquid drops 330 from the outlet 325 and onto a receiving medium.

Figure 4:
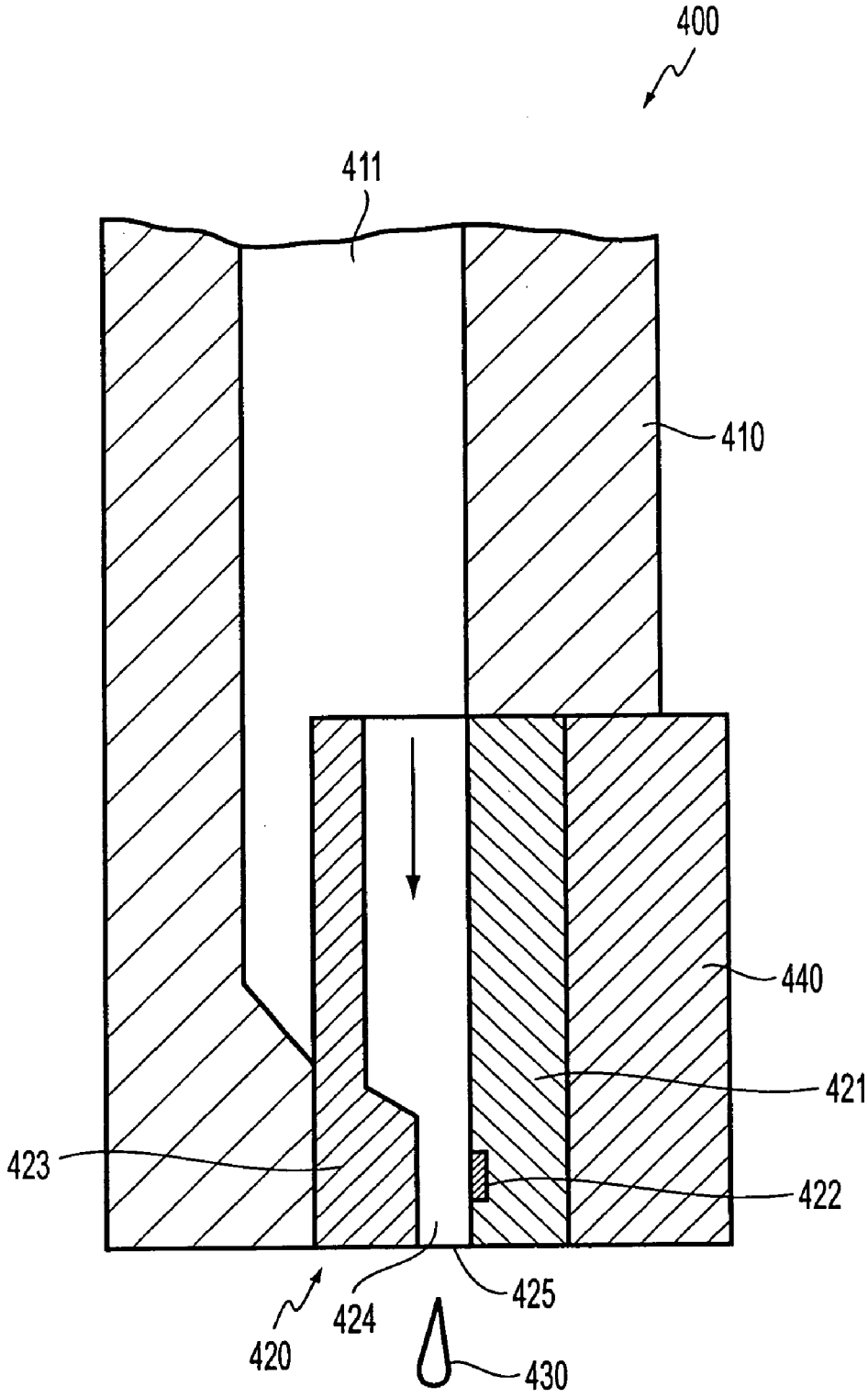
FIG. 4 is a block diagram illustrating a sectional view of a fourth exemplary embodiment of a fluid ejector element usable with various exemplary embodiments of the systems and methods according to this invention.

FIG. 4 is a cross-sectional view of a fourth exemplary embodiment of a fluid ejector element or head 400 including a structure usable to dissipate heat from the thermal fluid ejector head 400. As shown in FIG. 4, the fluid ejector element 400 includes a thermally conductive manifold 410, a thermal fluid ejector die module 420 and a secondary heat sink 440.

In various exemplary embodiments, the thermal fluid ejector die module 420 includes a heating element substrate 421 having a heating element 422 formed on the heating element substrate 421. The heating element substrate 421 is attached to a liquid path substrate 423 to provide fluid a channel 424 and a fluid an outlet 425. The thermal fluid ejector die module 420 is attached to the thermally conductive manifold 410.

In various exemplary embodiments, the thermally conductive manifold 410 includes a chamber 411. Fluid is supplied from a reservoir into the chamber 411 through an inlet. The fluid is then distributed to each of the channels 424. The pressure of bubbles developed in the channels 424 by the heating element 422 heating the fluid in the channel 424 that rejects liquid drops 430 from the outlet 425 and onto a receiving medium.

In various exemplary embodiments, the heating element substrate 421 is attached to a secondary heat sink 440, which radiates heat generated by the heating elements 422. A printed wiring member (not shown) is formed on the secondary heat sink 440 to connect to signal terminals on the thermal fluid ejector die module 420 through bonding wires. The secondary heat sink 440 provides additional thermal dissipation when the fluid ejector element 400 requires more thermal dissipation than is provided by the thermally conductive manifold 410.

Figure 5:
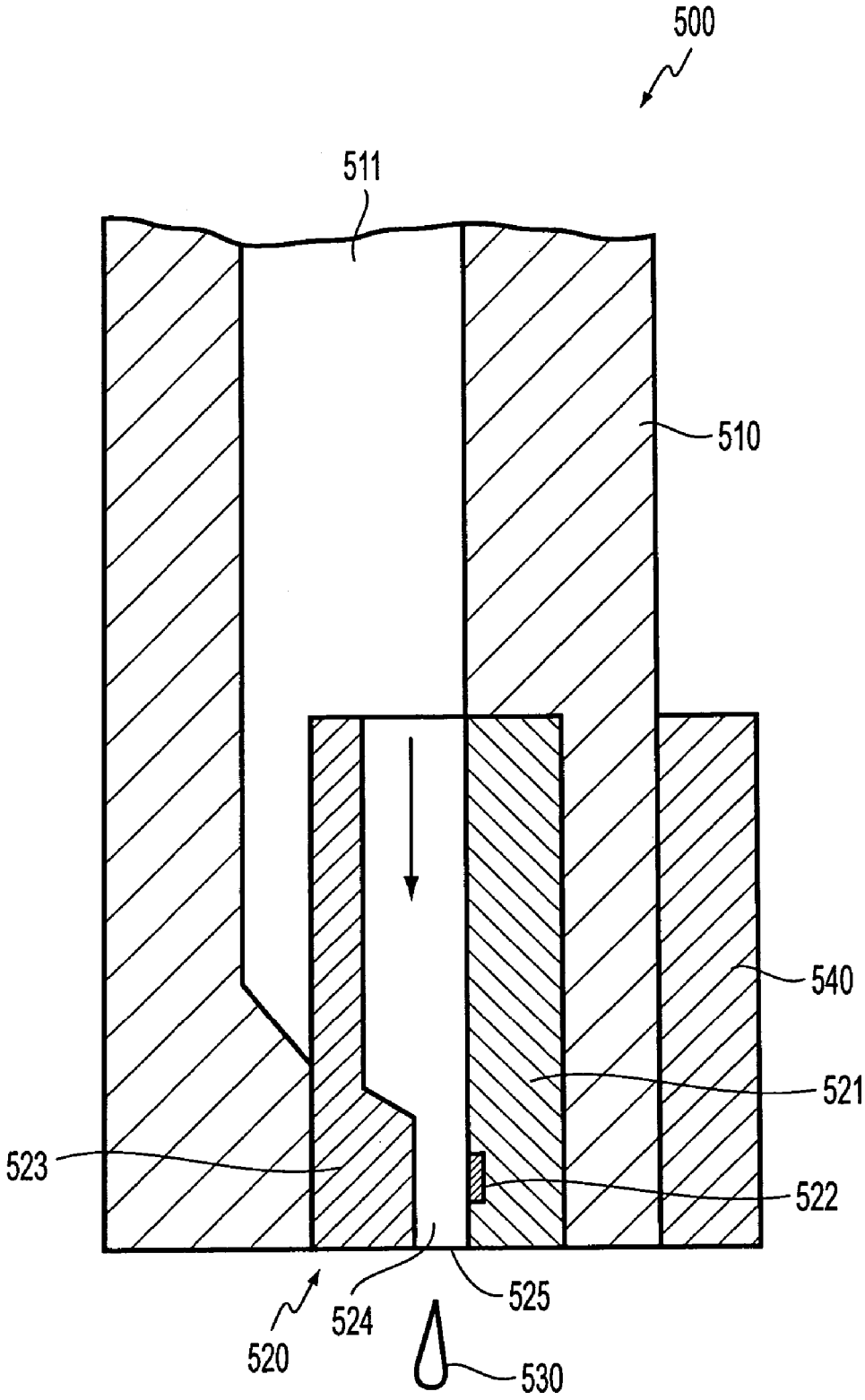
FIG. 5 is a block diagram illustrating a sectional view of a fifth exemplary embodiment of a fluid ejector element usable with various exemplary embodiments of the systems and methods according to this invention.

FIG. 5 is a cross-sectional view of a fifth exemplary embodiment of a fluid ejector element or head 500 including a structure usable to dissipate heat from the thermal fluid ejector head 500. As shown in FIG. 5, the fluid ejector element 500 includes a thermally conductive manifold 510, a thermal fluid ejector die module 520 and a secondary heat sink 540.

In various exemplary embodiments, the thermal fluid ejector die module 520 includes a heating element substrate 521 having a heating element 522 formed on the heating element substrate 521. The heating element substrate 521 is attached to a liquid path substrate 523 to provide a fluid channel 524 and a fluid outlet 525. The thermal fluid ejector die module 520 is attached to the thermally conductive manifold 510.

In various exemplary embodiments, the thermally conductive manifold 510 includes a chamber 511. Fluid is supplied from a reservoir into the chamber 511 through an inlet. The fluid is then distributed to each channel 524. The pressure of bubbles developed in the channel 524 by the heating element 522 heating the fluids in the channel 524 ejects liquid drops 530 from the outlet 525 and onto a receiving medium.

In various exemplary embodiments, the heating element substrate 521 is placed flush with the thermally conductive manifold 510. A printed wiring member (not shown) is attached to the thermally conductive manifold 510 to connect the heater element 522 to signal terminals on the thermal fluid ejector die module 520. The secondary heat sink 540 is attached to the thermally conductive manifold 510 to provide additional heat dissipation by radiating heat generated by the heating elements 522. The secondary heat sink 540 provides additional thermal dissipation when the fluid ejector element 500 requires more thermal dissipation than can be provided by the thermally conductive manifold 510.

Figure 6:
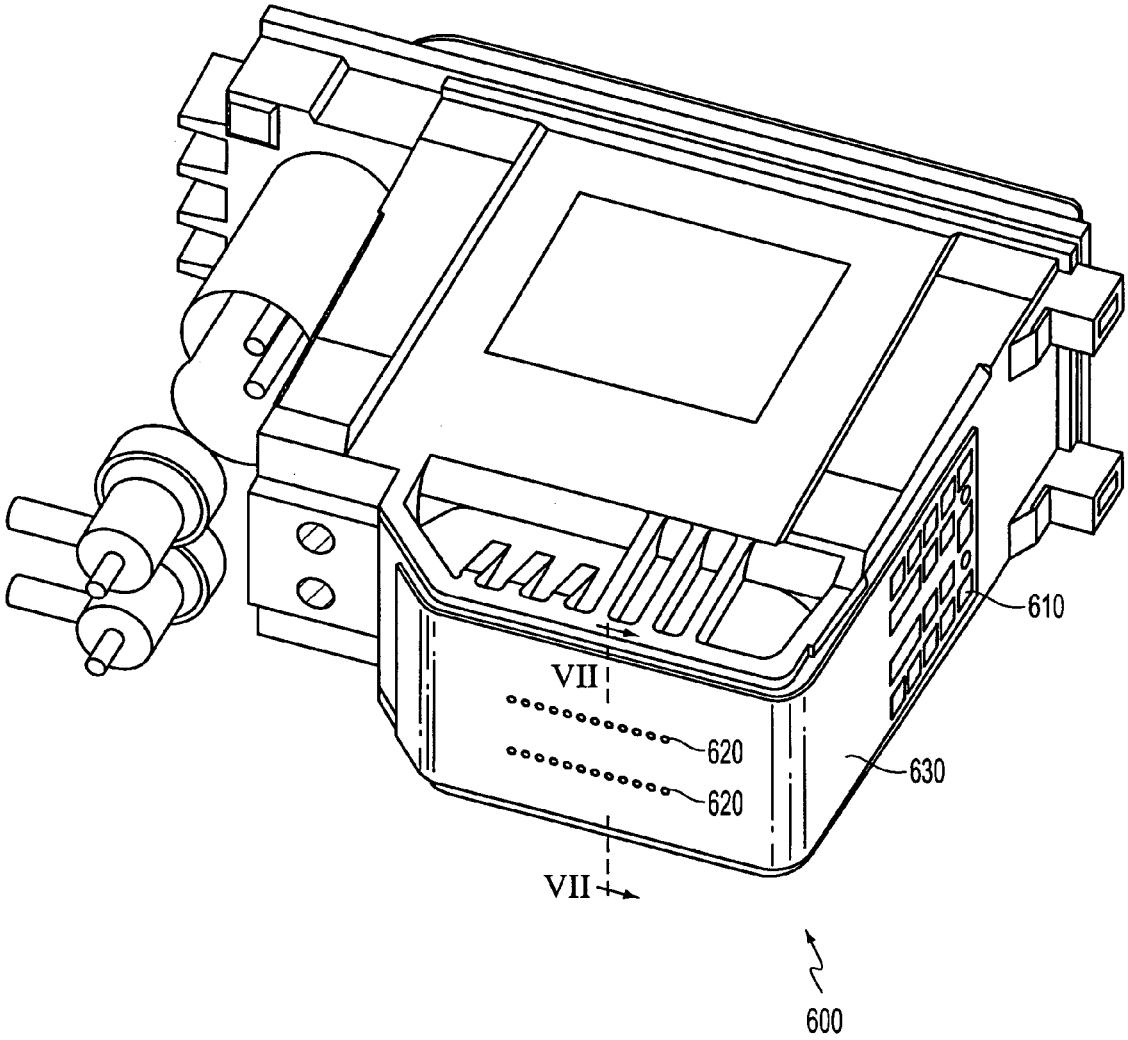
FIG. 6 is a block diagram illustrating a sixth exemplary embodiment of a fluid ejector element usable with various exemplary embodiments of the systems and methods according to this invention.

FIG. 6 illustrates a sixth exemplary embodiment of a thermally conductive manifold 600 including a structure usable to dissipate heat from the thermally conductive manifold 600. As shown in FIG. 6, the thermally conductive manifold 600 includes metal contact pads 610 and two parallel rows of offset nozzles 620 formed in a flexible substrate 630. The metal contact pads 610 are electrically connected to electrodes on a substrate carrying the fluid ejection elements.

Figure 7:
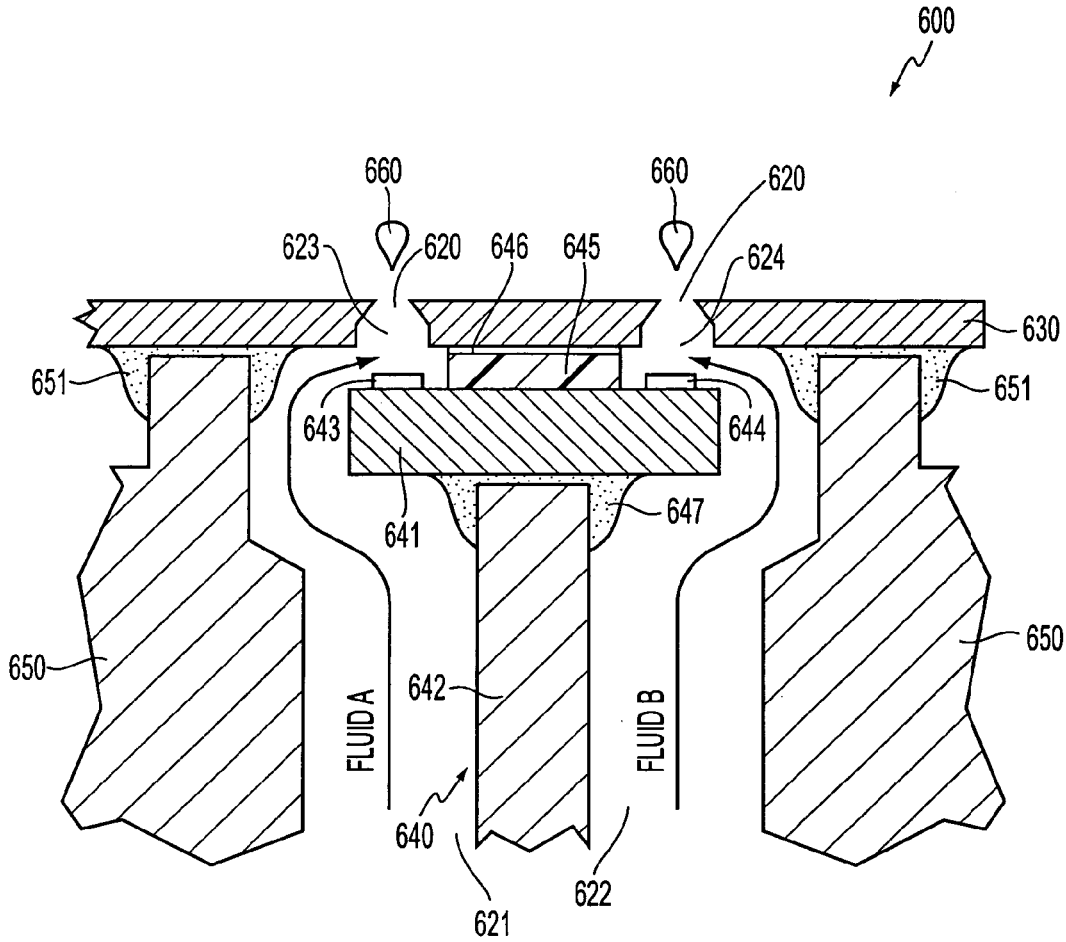
FIG. 7 is a sectional view of the fluid ejection element shown in FIG. 6 usable with various exemplary embodiments of the systems and methods according to this invention.

FIG. 7 is a cross-sectional view of the thermally conductive manifold 600 shown in of FIG. 6. As shown in FIG. 7, the thermally conductive manifold 600 includes a center structure 640 and a housing 650. The center structure 640 and/or the housing 650 are formed using a molded polymer containing at least one thermally conductive filler material. In various exemplary embodiments, the nozzle 620 includes dual fluid supply chambers 621 and 622 and dual fluid ejection chambers 623 and 624. The center structure 640 includes a substrate 641, a center wall 642, heating elements 643 and 644, a barrier layer 645, adhesive layer 646 and an adhesive 647. The housing 650 includes an adhesive 651.

In various exemplary embodiments, the fluids A and B flow in the fluid supply dual chambers 621 and 622, respectively, around outer edges of the substrate 641 and into the fluid ejection chambers 623 and 624, respectively. The center wall 642 separates the dual chambers 621 and 622. The heating elements 643 and 644 are selectively energized to eject droplets 660 of fluid from one of the associated nozzles 620.

In various exemplary embodiments, the nozzles 620 are formed in the flexible substrate 630, for example, by laser ablation. The metal contact pads 610 formed on the flexible substrate 630 are connected to conductive traces on the back of the flexible substrate 630. The other ends of the traces are connected to electrodes on the substrate 641, which are ultimately connected to the heating elements 643 and 644. In various exemplary embodiments, piezoelectric elements may be used instead of heating elements. The flexible substrate 630 is attached to the housing 650 by the adhesive 651. The barrier layer 645 separating the fluid ejection chambers 623 and 624 from each other may be formed using a photoresist. The adhesive layer 646 attaches the barrier layer 645 to the bottom of the flexible substrate 630. The adhesive 647 attaches the substrate 641 to the center wall 642 and creates a fluid seal separating the chambers 621 and 622.

Figure 8:
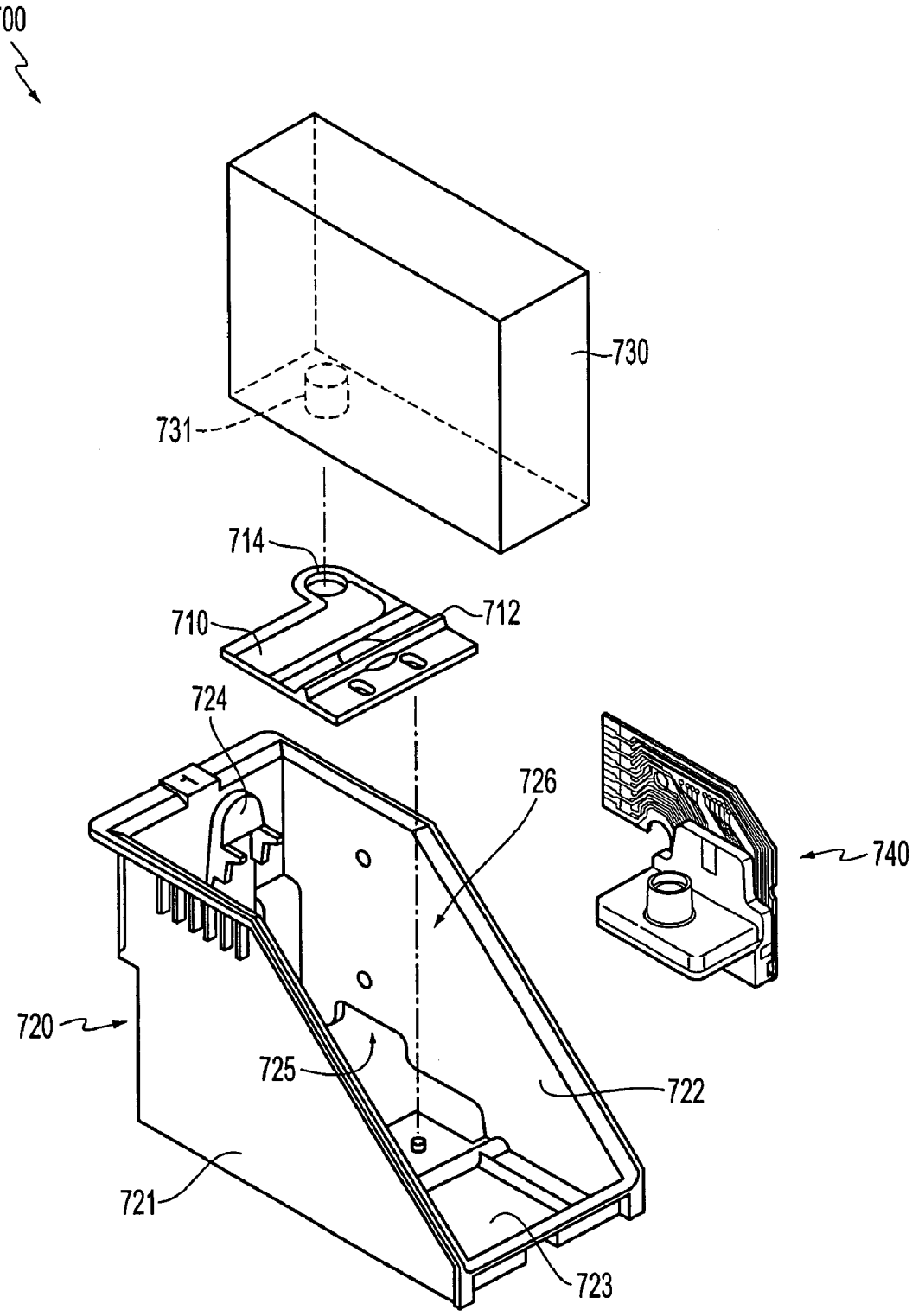
FIG. 8 is a block diagram illustrating a seventh exemplary embodiment of a fluid ejector carriage usable with various exemplary embodiments of the systems and methods according to this invention.

FIG. 8 illustrates a seventh exemplary embodiment of a thermal fluid ejector carriage 700 including a structure usable to dissipate heat from the thermal fluid ejector head. As shown in FIG. 8, the thermal fluid ejector carriage 700 includes a seal member 710, a housing 720, a print element 740 and a fluid supply cartridge or tank 730. In various exemplary embodiments, the housing 720 is a one-piece molded plastic member. In various exemplary embodiments, the housing 720 has sidewalls 721 and 722, a bottom wall 723, a receiving area 726, an integrally formed resilient latch 724, substantially open top and front ends, and an aperture 725 extending through the housing. The receiving area 726 is suitably sized and shaped to removable receive the fluid supply cartridge or tank 730. The fluid supply cartridge or tank 730 can be inserted into and removed from the receiving area 726 through the substantially open top and front ends of the housing 720. The latch 724 is configured to resiliently latch fluid supply cartridge or the tank 730 inside the receiving area 726. The latch 724 can deflect in a general cantilever fashion. A user can deflect the top end of the latch 724 rearward to remove or unlatch the fluid supply cartridge or tank 730 from the housing 720.

In various exemplary embodiments, the aperture 725 is formed in, or extends through, portions of the bottom wall 723 and the right side wall 722. However, in other exemplary embodiments, the aperture 725 could be formed in, extend through, the bottom wall 723 or any one or more of the sidewalls 721 and 722 of the housing 720.

The print element 740 is inserted through the aperture 725 into the receiving area 726. The seal member 710 is placed against the interior bottom wall 723 of the housing 720. In various exemplary embodiments, the seal member 710 is formed using an elastomeric material that includes a resilient upwardly facing ridge 712 and a hole 714. When used, the ridge 712 functions as a spring. The ridge 712 is resiliently compressed or deflected when the fluid supply cartridge or tank 730 is inserted into the receiving area 726 and helps to distribute some of the mounting load expanded when the fluid supply cartridge or tank 730 is placed into the receiving area 726 of the housing 720, rather than all of that load being placed against the print element 740. The spring feature of the ridge 712 also biases the fluid supply cartridge or tank 730 towards the latch 724 to stably hold the fluid supply cartridge or tank 730 with minimal forces being exerted against the print element 740 during loading. In various exemplary embodiments, the fluid supply cartridge or tank 730 includes a receiving hole 731 that receives the print element 740.

Figure 9:
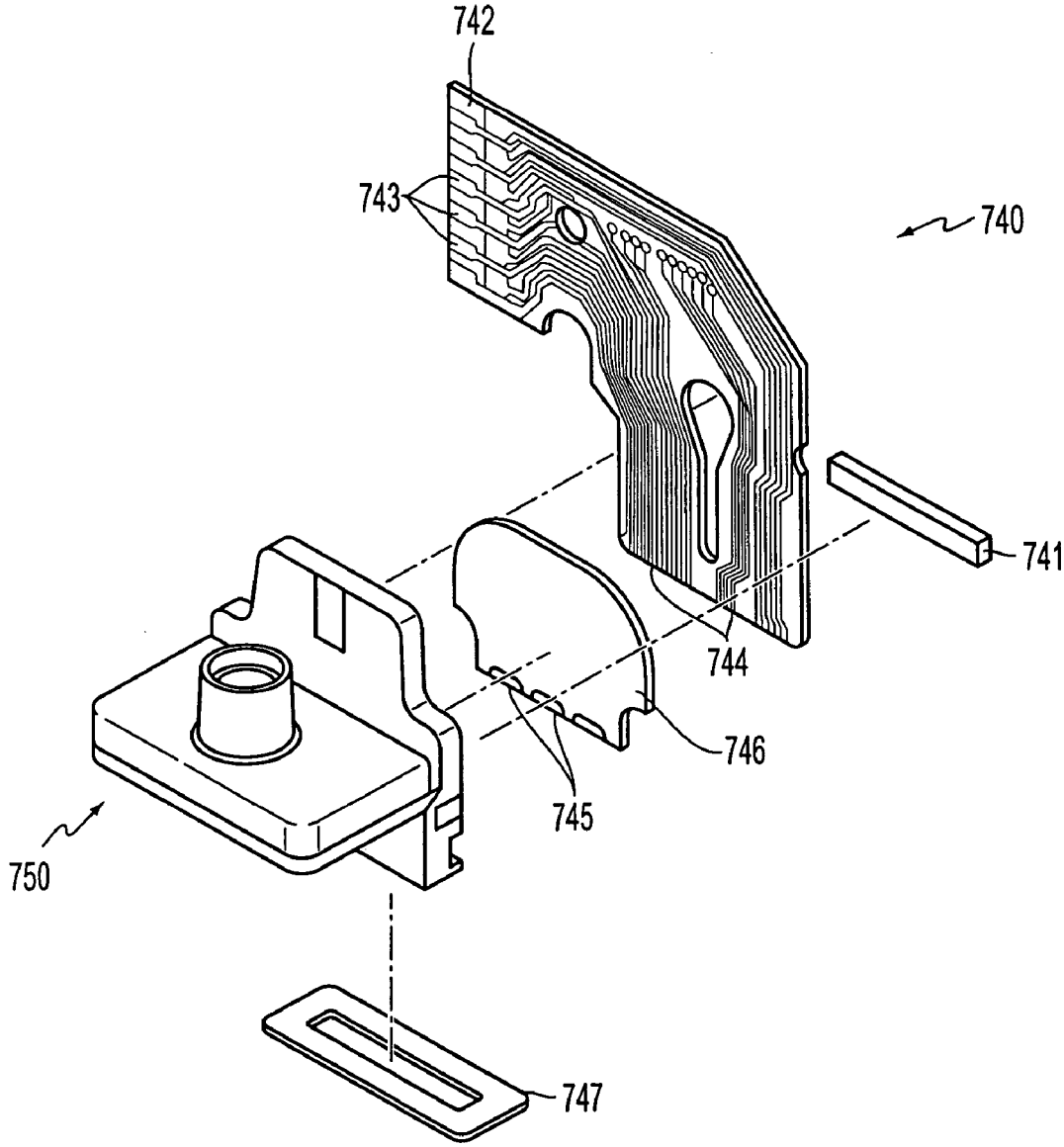
FIG. 9 is a block diagram illustrating in greater detail various elements of the fluid ejector carriage of FIG. 8 usable with various exemplary embodiments of the systems and methods according to this invention.

FIG. 9 shows in greater detail one exemplary embodiment of the print element 740. As shown in FIG. 9, the print element 740 includes a thermal fluid ejector die module 741, a printed wiring member 742, a fluid seal 746, a face tape 747 and a fluid manifold assembly 750. In various exemplary embodiments, the printed wiring member 742 includes electrically conductive traces on a substrate, with contact pads 743 at one end and contact areas 744 at an opposite end. The contact pads 743 are sized and shaped to be connected to an electrical connector.

The printed wiring member 742 shown in FIG. 9 has a single row of contacts on one side of the edge receiving area. However, any suitable type of electrical connection could be made. The printed wiring member 742 also has through-holes that a post of the fluid ejector manifold assembly 750 can extend through.

The thermal fluid ejector assembly 740 is also operably connected to the contact areas 744 of the printed wiring member 742. The fluid seal 746 covers a side of the fluid manifold assembly 750 and has slots 745 that fluid can flow through, from an outlet of the fluid manifold assembly 750 to the thermal fluid ejector die module 741.

Figure 10:
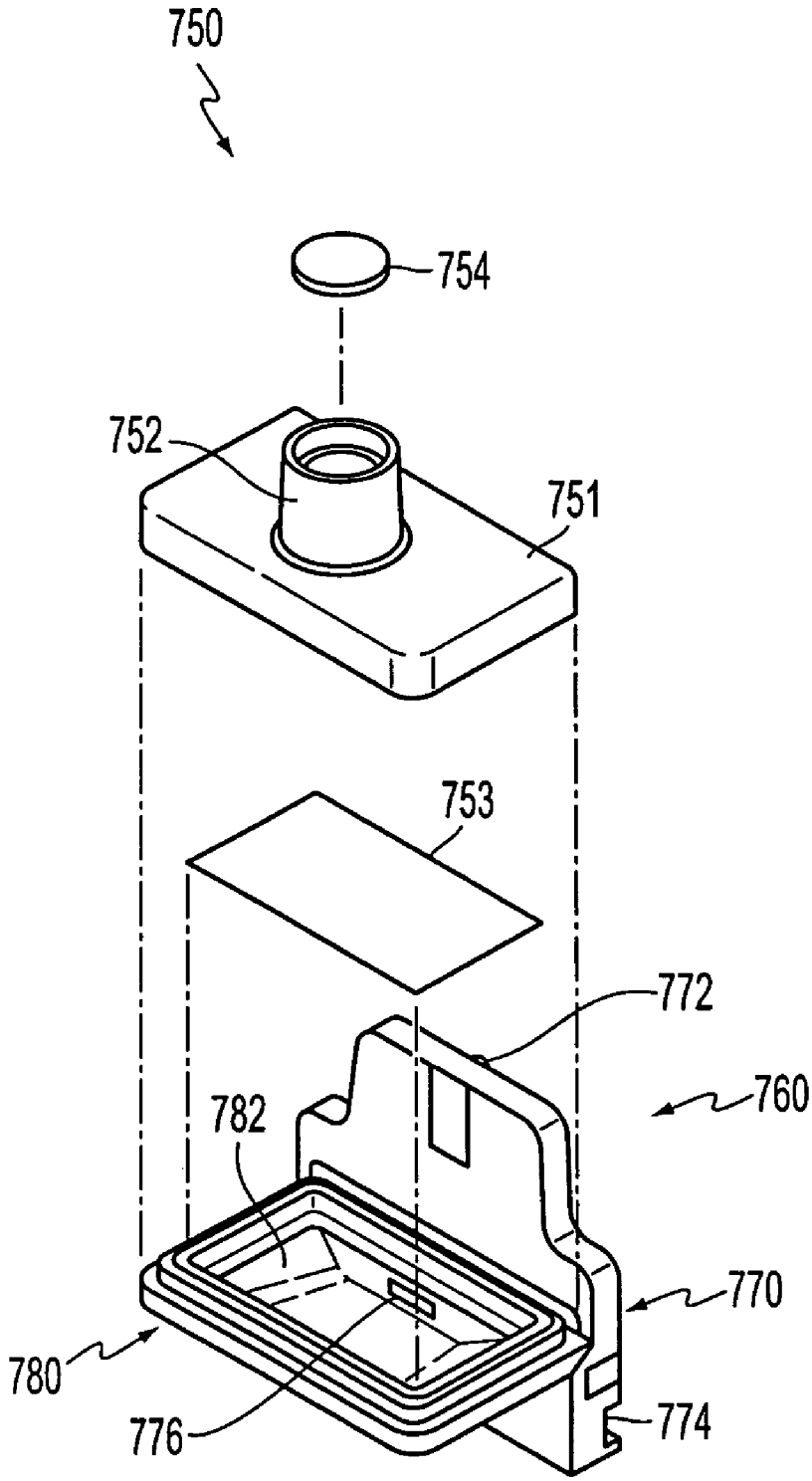
FIG. 10 is a block diagram illustrating a fluid manifold assembly of the fluid ejector element of FIG. 9 usable with various exemplary embodiments of the systems and methods according to this invention.

FIG. 10 illustrates in greater detail one exemplary embodiment of a fluid manifold assembly 750. As shown in FIG. 10, the fluid manifold assembly 750 includes a cover 751, two filters 753 and 754, and a base member 760. The base member 760 and the cover 751 are formed using a molded polymer containing at least one thermally conductive filler material. The cover 751 includes a mount 752 extending upward from the top side of the cover 751.

In various exemplary embodiments, the base member 760 includes a first section 770 and a second section 780. The first section 770 includes one or more mounting posts 772, a recess 774 that is able to receive and support the fluid ejector assembly 740, and an outlet 776 from the second section 780.

The second section 780 extends generally perpendicular to the first section 770. The second section 780 has an ink well 782 which receives the first filter 753 and is in communication with the outlet 776. The cover 751 is mounted on the second section 780, with the first filter 753 sandwiched between the cover 751 and the second section 780.

The second filter 754 is attached to the inside of the mount 752. The second filter 754 is a coarser filter than the first filter 753. The mount 752 is sized and shaped to extend into the receiving hole 731 in the fluid supply cartridge or tank 730. The mount 752 is also suitably sized and shaped to have a hose or conduit (not shown) from a different type of fluid supply fitted around the outer perimeter of the mount 752.

Figure 11:
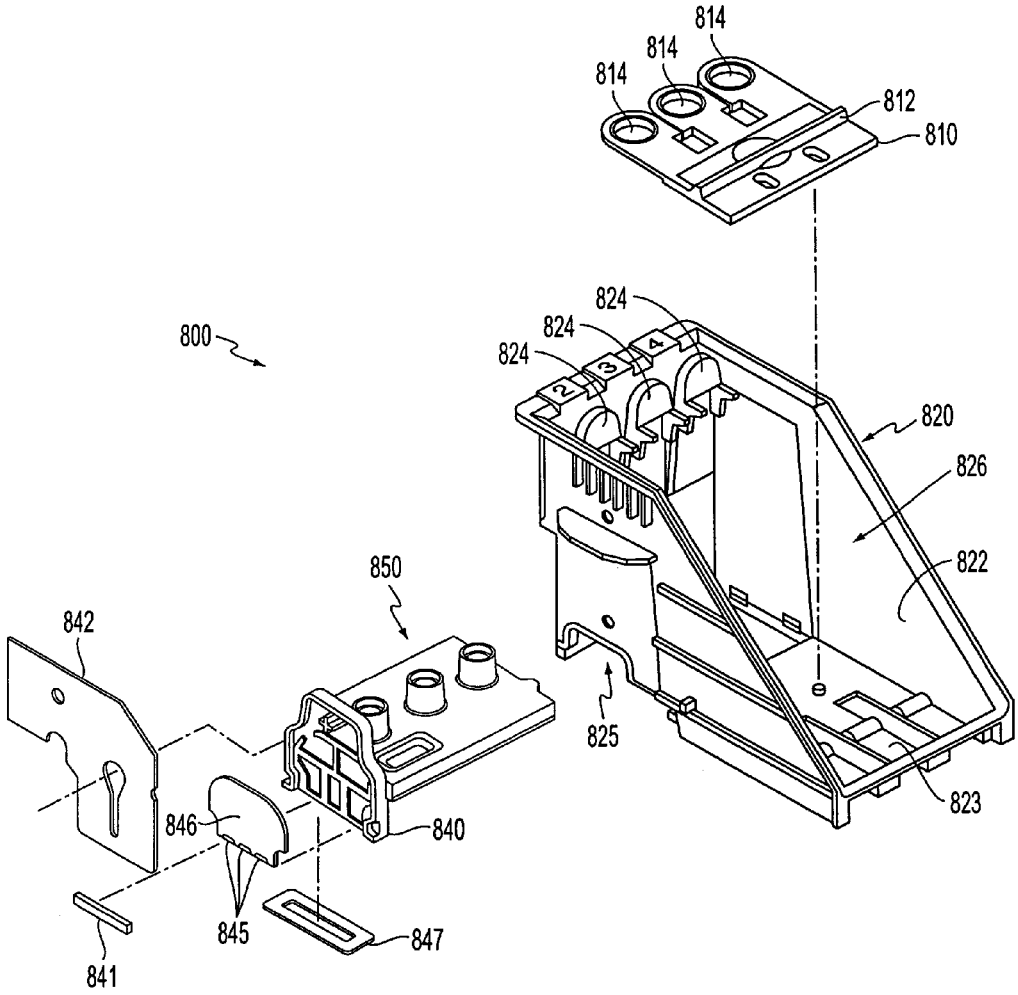
FIG. 11 is a block diagram illustrating an eighth exemplary embodiment of a fluid ejector carriage usable with various exemplary embodiments of the systems and methods according to this invention.

FIG. 11 shows a second exemplary embodiment of a fluid ejector carriage 800 that dissipates heat from the thermal fluid ejector head. As shown in FIG. 11, the fluid ejector carriage 800 includes a housing 820, a print element 840 and a seal member 810. In various exemplary embodiments, the housing 820 is a one-piece member formed using a polymer material.

In various exemplary embodiments, the housing 820 includes a receiving area 826, a number of integrally formed resilient latches 824, substantially open top and front ends, sidewalls 822, bottom wall 823, and an aperture 825 extending through the housing 820.

The receiving area 826 is suitably sized and shaped to removably receive three ink supply cartridges or tanks similar that are the fluid tank 730, but smaller in width and having different types of fluids, such as, for example differently colored inks. The fluid supply cartridge or tanks can be inserted into and removed from the receiving area 826 through the substantially open top and front ends of the housing 820. The latches 824 are configured to resiliently snap-lock latch the fluid supply cartridge or tanks inside the receiving area 826. The latches 824 can deflect in a general cantilever fashion. A user can manually deflect the top end of the latches 824 rearward to remove or unlatch the fluid supply cartridge or tanks from the housing 820.

In various exemplary embodiments, the aperture 825 extends through a corner of the housing 820 and through portions of the bottom wall 823 and the left side wall 822. However, in alternate embodiments the aperture could extend through the bottom wall 823 or any one or more of the side walls 822 of the housing 820.

In various exemplary embodiments, the print element 840 includes a thermal fluid ejector die module 841, a printed wiring member 842, a fluid seal 846, a face tape 847 and a fluid manifold assembly 850. The printed wiring member 842 includes electrically conductive traces on a substrate with contact pads at one end and contact areas at an other end. The printing wiring member 842 includes holes that posts of the fluid manifold assembly 850 extend through to mount the fluid manifold assembly and the printed wiring member 842. The fluid seal 846 covers a side of the fluid manifold assembly 850 and has slots 845 through which fluid can flow from outlets of the fluid manifold assembly 850 to the fluid ejector die module 841.

The fluid manifold assembly 850 extends through the aperture 825 into the receiving area 826. The seal member 810 is placed against the interior bottom wall 823 of the housing 820 with the mounts 852 extending through a number of holes 814. In various exemplary embodiments the seal member 810 is formed using an elastimeric material and includes a resilient upwardly facing ridge 812. The ridge 812 functions as a spring. The ridge 812 is resiliently compressed or deflected when the fluid supply cartridge or tanks are inserted into the receiving area 826 and helps to distribute some of the mounting load, that occurs when the fluid supply cartridge or tanks are placed into the receiving area 826 of the housing 820, rather than the all of the load being placed against the mounts 852 and the print element 840. The spring feature of the ridge 812 also biases the fluid supply cartridge or tanks toward the latches 824 to stably hold the fluid supply cartridge or tanks with minimal force being exerted against the print element 840.

Figure 12:
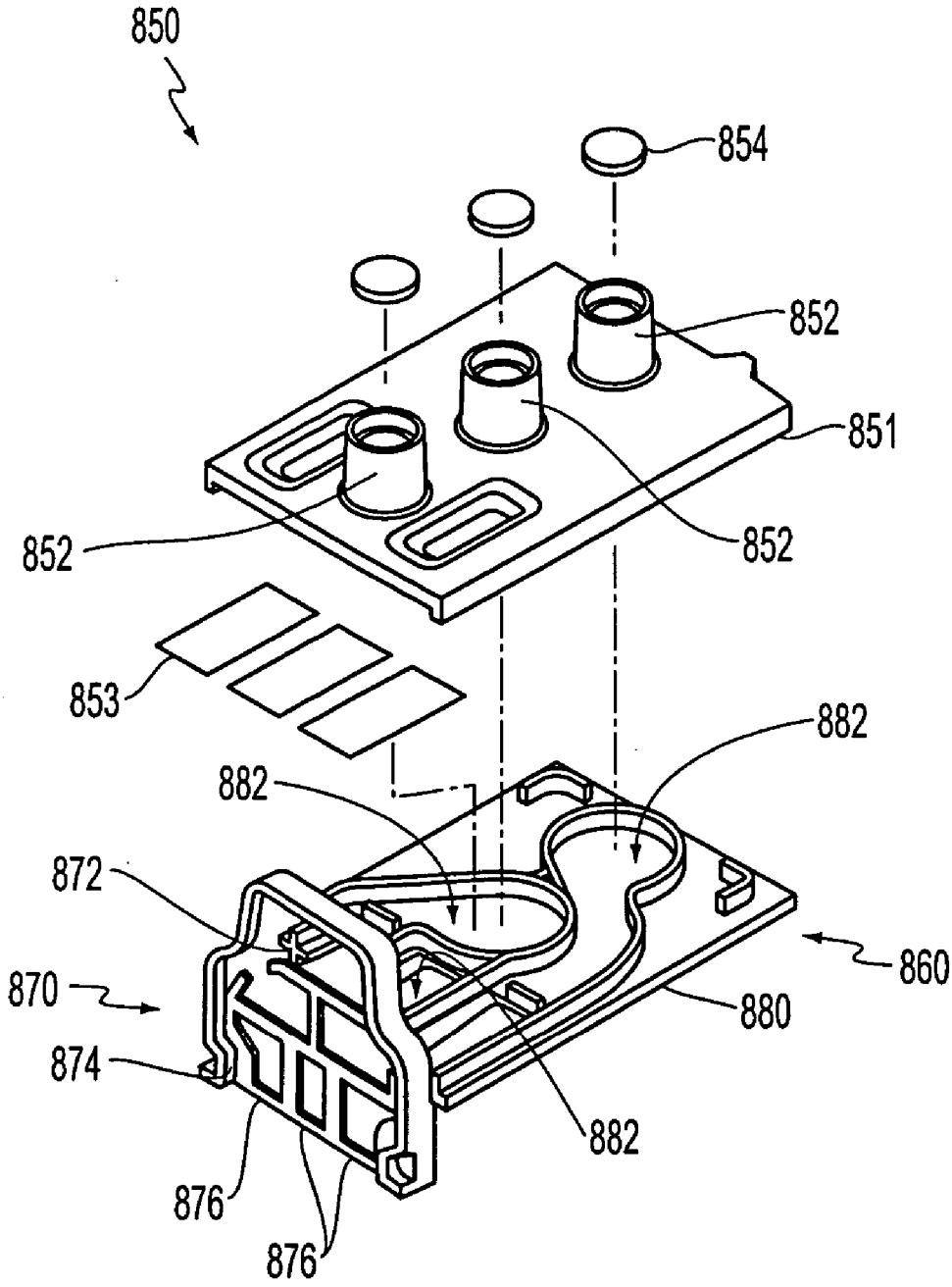
FIG. 12 is a block diagram illustrating a fluid manifold assembly of the fluid ejector carriage of FIG. 11 usable with various exemplary embodiments of the systems and methods according to this invention.

FIG. 12 illustrates in greater detail one exemplary embodiment of the fluid manifold assembly 850 that dissipates heat from the thermal fluid ejector head. As shown in FIG. 12, the fluid manifold assembly 850 includes a cover 851, two types of filters 853 and 854 and a base member 860. The base member 860 and the cover 851 are formed using a polymer material that contains one or more thermally conductive filler materials that are usable to cool the print element 840.

The base member 860 includes a first section 870 and a second section 880. The first section 870 includes a mounting post 872, a recess 874 that receives and supports the fluid ejector die module 841, and three outlets 876 from the second section 880. The second section 880 extends generally perpendicularly from the first section 870, and includes three fluid wells 882 that receive the filters 853 and that communicate with the outlets 876. The cover 851 is mounted on the second section 880, with the filters 853 being sandwiched between the cover 851 and the second section 880. The cover 851 includes three mounts 853 extending upwardly from a top side of the cover 851. The filters 854 are positioned inside the mounts 852. The filters 854 are coarser filters than the filters 853. The mounts 852 are sized and shaped to extend into respective receiving holes in the fluid supply cartridges or tanks. The mounts 852 are also suitably sized and shaped to have a hose or conduit (not shown) from a different type of fluid supply mounted on the mounts 852 around the outer perimeter of the mounts 852. The mounts 852 extend generally parallel relative to the first section 870.

Figure 13:
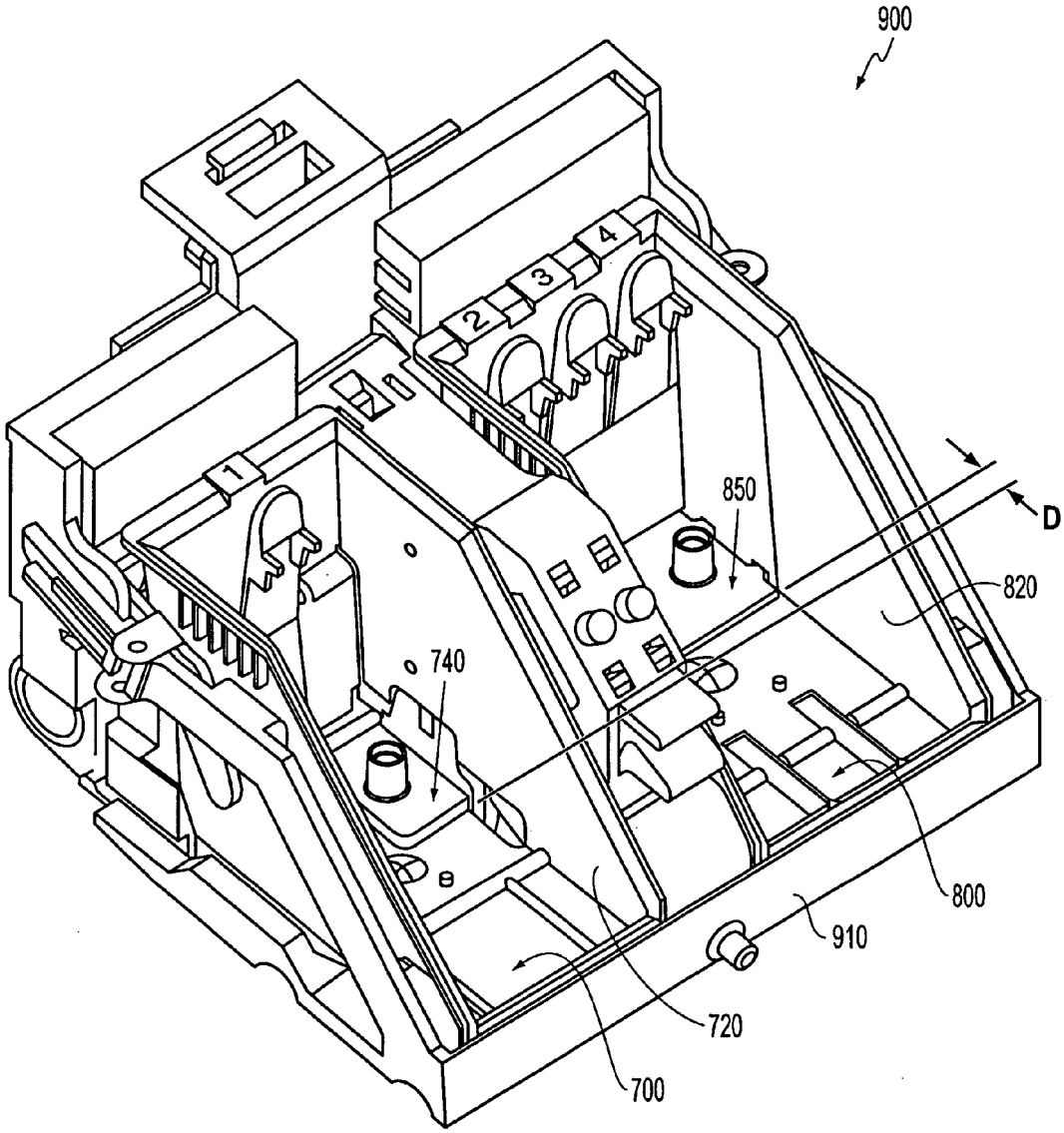
FIG. 13 is a block diagram illustrating a fluid ejector head assembly incorporating the fluid ejector carriages of FIG. 8 and FIG. 11 usable with various exemplary embodiments of the systems and methods according to this invention.

FIG. 13 shows various exemplary embodiments of a print head assembly 900 incorporating the fluid ejector carriages 700 and 800. As shown in FIG. 13, the fluid ejector assembly 900 includes a master carriage 910 and the fluid ejector carriages 700 and 800 mount in the master carriage 910. The carriage 910 is intended to be movably mounted on a frame of a printing device, such as a thermal ink jet printer, for reciprocating lateral sliding movement on a frame, as generally known in the art.

In various exemplary embodiments, the fluid ejector carriage 700 is designed to contain a black fluid ejector head and the fluid ejector carriage 800 is designed to contain a color fluid ejector head. However, in various exemplary embodiments, the print head assembly configuration could be varied, such as a carriage with only a single black fluid ejector head, a carriage with multiply black fluid ejector print heads, a carriage with multiple color ejector heads, or any other suitable configuration.

The two print elements 740 and 850 positioned next to each other and contain separate and spaced ink tank receiving housings 720 and 820. In various exemplary embodiments, the relative position of the two print elements 740 and 850 to each other is staggered or stepped relative to the front of the master carriage 910 to provide a precise offset D between the front ends of fluid ejector die modules. However, in other exemplary embodiments, an offset D between the print elements 740 and 750 does not need to be provided, or any suitable offset distance could be provided. In various exemplary embodiments, a single print element could be designed to have four ink tanks connected to it, (such as, for example, one black and three color) and/or only one housing that can hold four or more fluid supply cartridges or tanks. The black fluid supply cartridges or tank could be replaced by a three fluid supply cartridges or tanks (i.e., red, green and blue) or low density inks for photographic printing. Thus, two of the three color print elements could be used in a single device.

Figure 14:
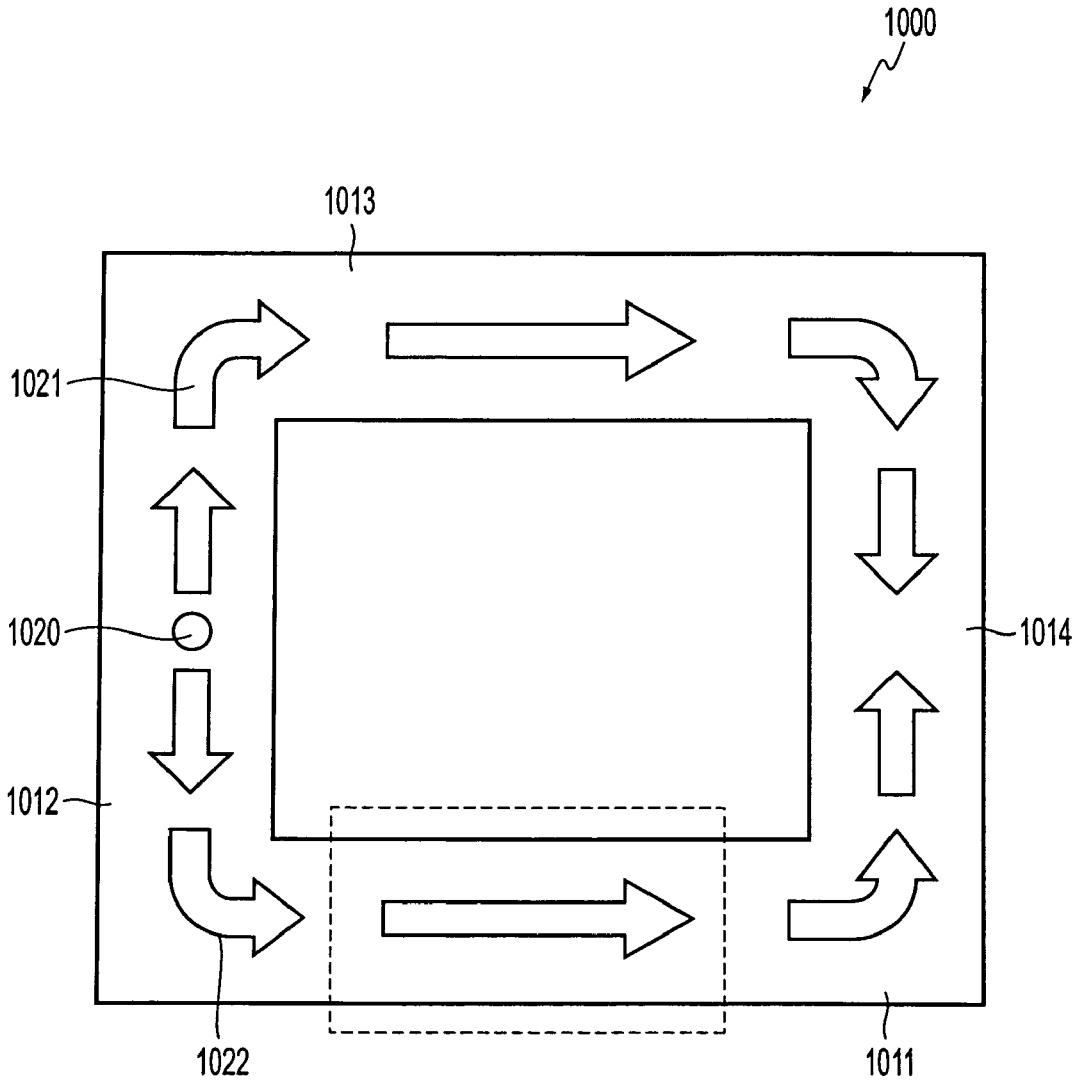
FIG. 14 is a schematic diagram illustrating one exemplary embodiment of a technique for molding a manifold and/or container usable according to this invention.

As shown in FIG. 14, a molding apparatus 1000 includes sidewall channels 1011, 1012, 1013 and 1014. A highly thermally-conductive polymer material is injected into the molding apparatus 1000 through a gate 1020 and flows in the flow directions 1021 and 1022 through the channels formed by the sidewalls 1011, 1012, 1013 and 1014. The flow directions 1021 and 1022 orient at least one filler material that has been mixed into in the highly thermally-conductive polymer material so that the one or more filler materials extend between a surface of the manifold that receives heat from the fluid ejector head and one or more heat dissipation surfaces of the manifold. A fluid containment device may be molded in a similar manner to dissipate heat from the fluid ejector die module.

As shown in FIG. 14, the one or more thermally conductive filler materials are oriented parallel to the die module. As a result, as shown in Table 1, coefficient of thermal expansion is obtained for the manifold that is similar to that of the material used to make the die module. Thus, the bond between the manifold and the die module is not subjected to significant stress due to temperature changes. In addition, the oriented thermally conductive filler materials provide an effective manifold for dissipating heat from the fluid ejector head.

Figure 15:
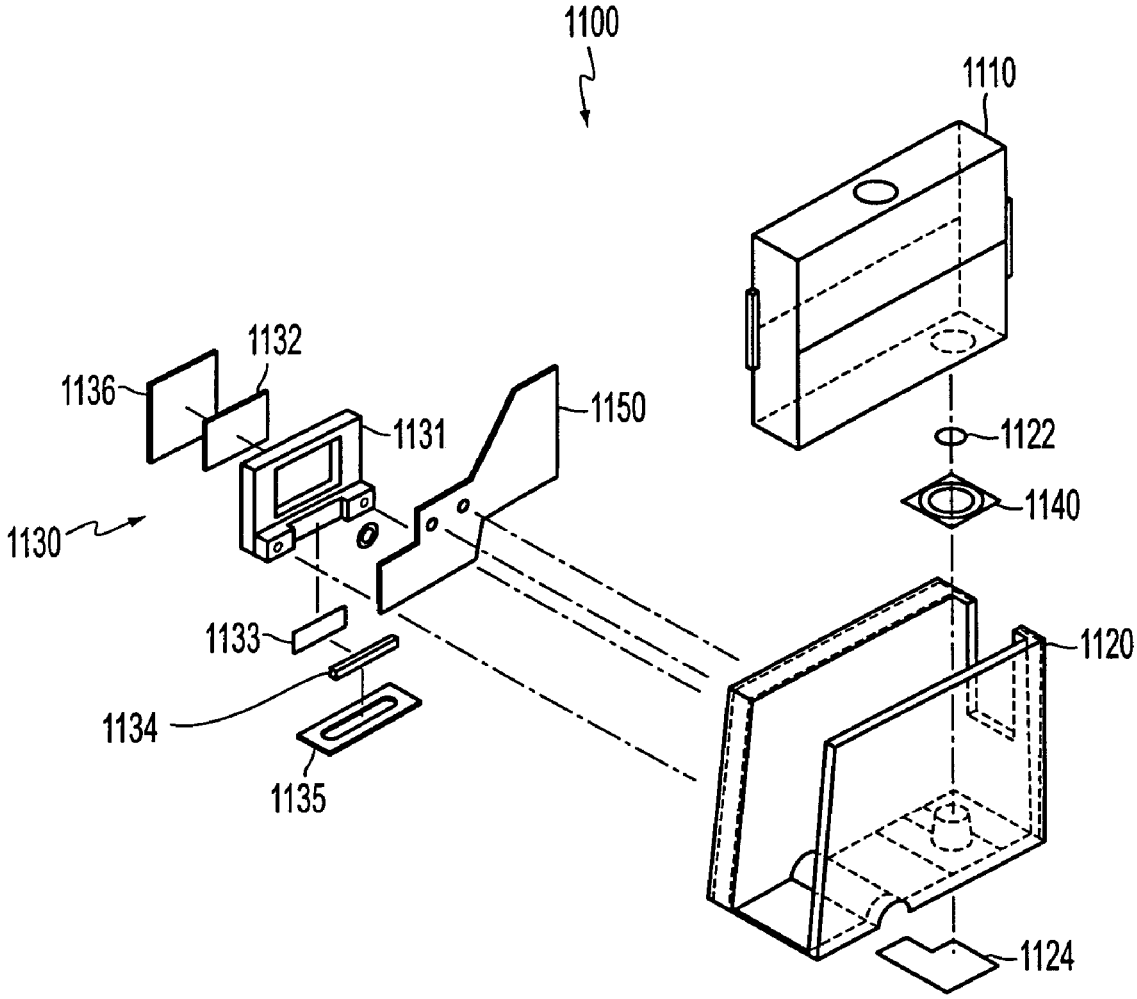
FIG. 15 is a block diagram illustrating a ninth exemplary embodiment of a fluid ejector carriage usable with various exemplary embodiments of the systems and methods according to this invention.

FIG. 15 illustrates a third exemplary embodiment of a fluid ejector assembly 100 that dissipates heat from a thermal fluid ejector die module 1134. As shown in FIG. 15, the fluid ejector assembly 1100 includes a fluid supply cartridge or tank 1110, a fluid manifold member 1120, a manifold assembly 1130, a seal 1140, and a printed wiring member 1150.

In various exemplary embodiments, the fluid manifold member 1120 includes a coarse filter 1122 and a manifold cover 1124. The manifold assembly 1130 includes a manifold filter cover 1131, a fine filter 1132, an adhesive strip 1133, the fluid ejector die module 1134, a face plate 1135 and a fine filter cover 1136.

In various exemplary embodiments, the fluid tank 1110 is mounted in the manifold member 1120 and fluid flows through manifold member 1120 to the fine filter 1132 and the manifold filter cover 1131 on the opposite side of the printed wiring member 1150. The fluid is then filtered before it passes to the fluid ejector die module 1134. The fluid ejector die module 1134 is located on the opposite side of the printed wiring member 1150 from the manifold member 1120. Thus, forces that occur when the fluid supply cartridge or tank 1110 is loaded into the manifold member 1120 are not directly transferred to the fluid ejector die module 1134.

In various exemplary embodiments, this design allows heat to be stored in the ink and removed with drop ejection. With this type of design, the fluid ejector assemblies 900 could be located almost adjacent to each other with only the manifold filter covers 1131 between adjacent fluid ejector assemblies 1100. In various exemplary embodiments, a fluid ejector cartridge which is made by joining two manifolds 1120 and 1130 together. There are multiple purposes and advantages obtained when using the two manifold approach. For example, the first manifold 1130 can be placed on each die and different versions of the second manifold 1120 can be designed for different product families. Also, any precision molded features can be contained in a smaller first manifold, thus providing tolerance relief and wider material choice for a second larger manifold. This can be used during assembly inspection, to print test the die with the first manifold to find rejects before final assembly begins.

Figure 16:
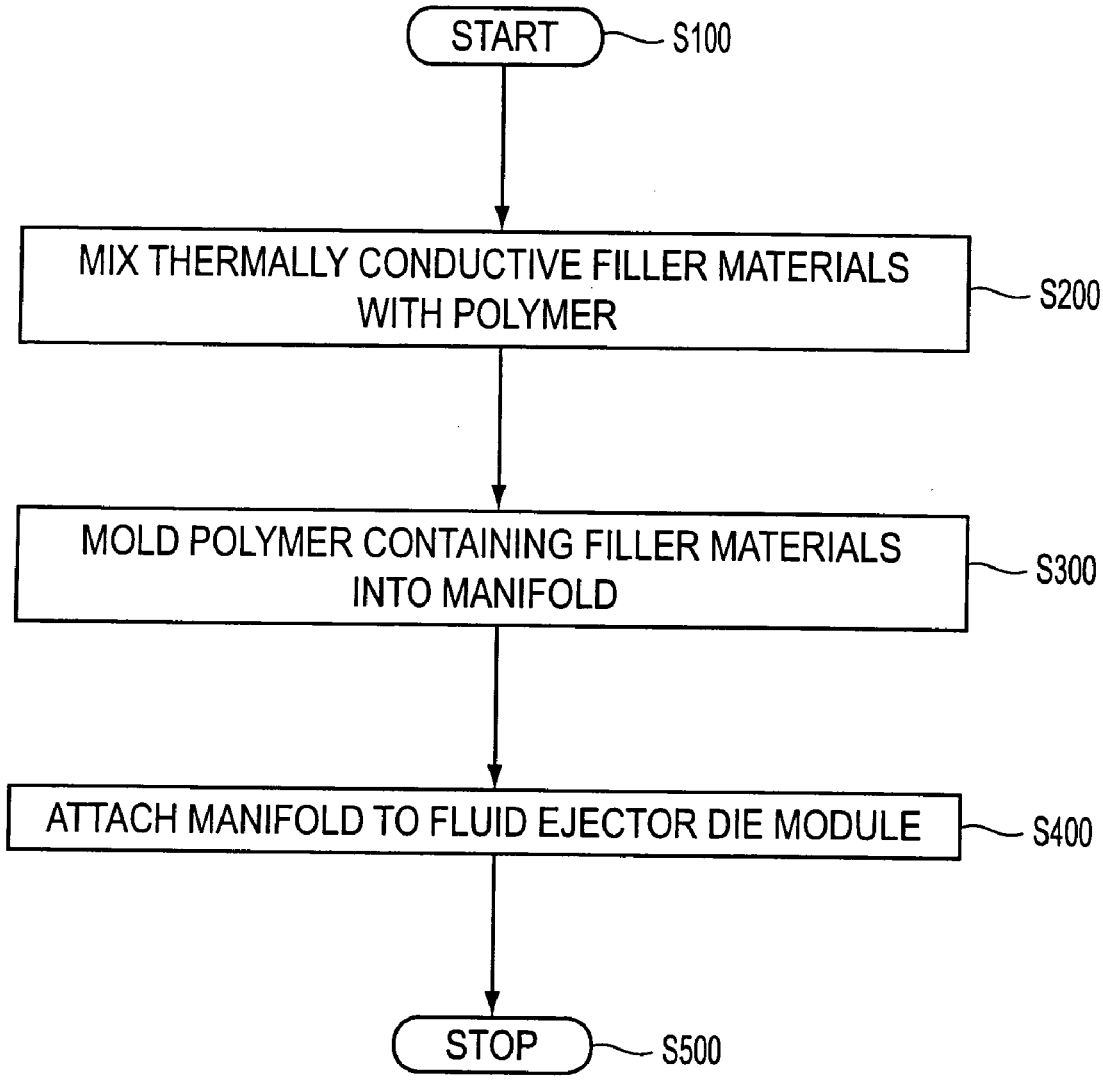
FIG. 16 is a flowchart outlining a first exemplary embodiment of a method for manufacturing a fluid ejector head having a manifold according to this invention.

FIG. 16 is a flowchart outlining a first exemplary embodiment of a method for manufacturing a manifold according to this invention. As shown in FIG. 16, operation of the method begins in step S100, and continues to step S200, where one or more thermally conductive filler materials are mixed with a polymer. Then, in step S300, the polymer containing the one or more filler materials are molded into a manifold. The one or more filler materials may be oriented along a designed thermal flow direction, as shown in FIG. 14. Next, in step S400, the manifold is attached to a fluid ejector die module. Finally, operation continues to step S500, where operation of the method ends.

Figure 17:
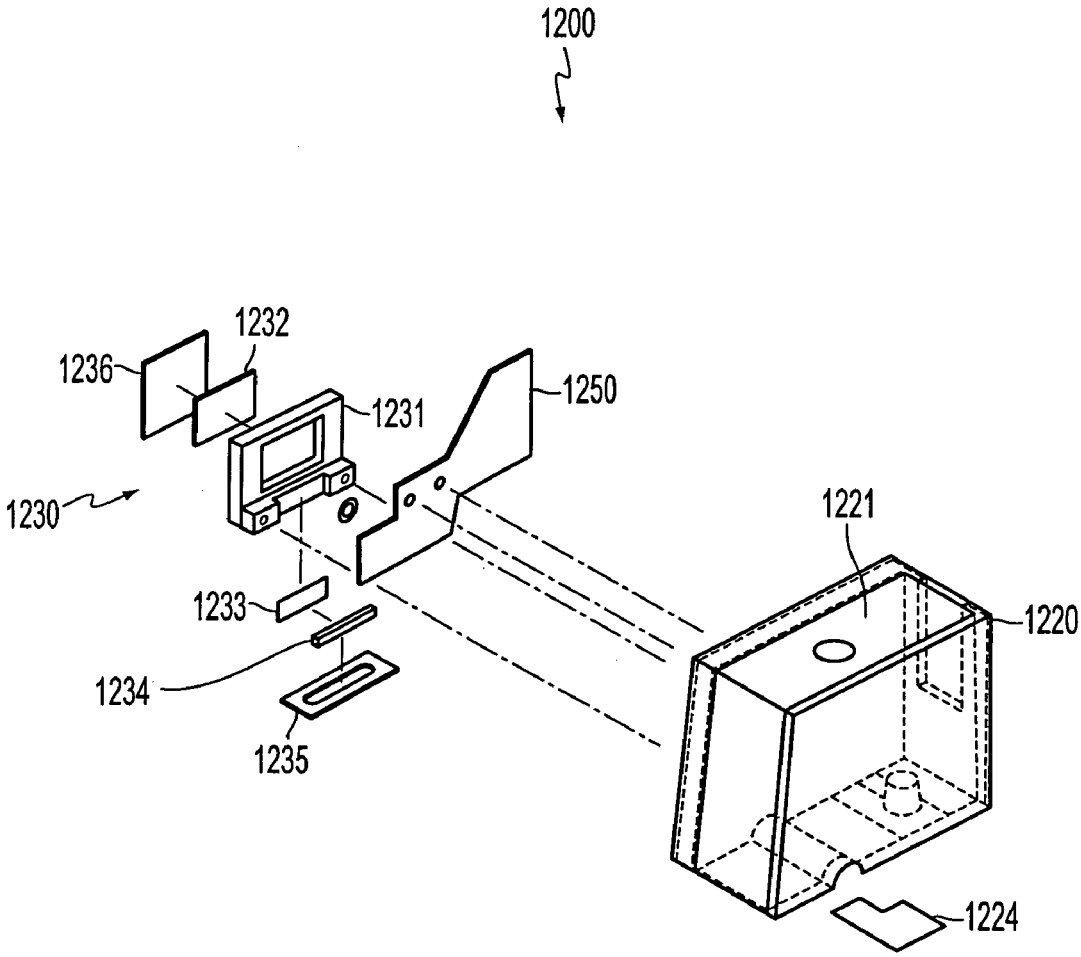
FIG. 17 is a block diagram illustrating a tenth exemplary embodiment of a fluid ejector carriage usable with various exemplary embodiments of the systems and methods according to this invention.

FIG. 17 illustrates a fourth exemplary embodiment of a fluid ejector assembly 1200 that dissipates heat from a thermal fluid ejector die module 1234. As shown in FIG. 17, the fluid ejector assembly 1200 includes an integrated fluid tank receiving housing and fluid manifold member 1220 having a manifold cover 1224, a manifold assembly 1230, and a printed wiring member 1250.

In various exemplary embodiments, the manifold assembly 1230 includes a manifold filter cover 1231, a fine filter 1232, an adhesive tape 1233, the fluid ejector die module 1234, a face plate 1235 and a fine filter cover 1236.

In various exemplary embodiments, a fluid tank portion 1221 is integrated into the manifold member 1220 and fluid flows through the manifold member 1220 to the fine filter 1232 and manifold filter cover 1231 that are located on the opposite side of the printed wiring member 1250. The fluid is then filtered before it is passed to the fluid ejector die module 1234. The fluid ejector die module 1234 is located on the opposite side of the printed wiring member 1250 from the manifold member 1220.

In various exemplary embodiments, this design also allows heat to be stored in the ink and removed with drop ejection, as discussed above with respect to FIG. 15.

Figure 18:
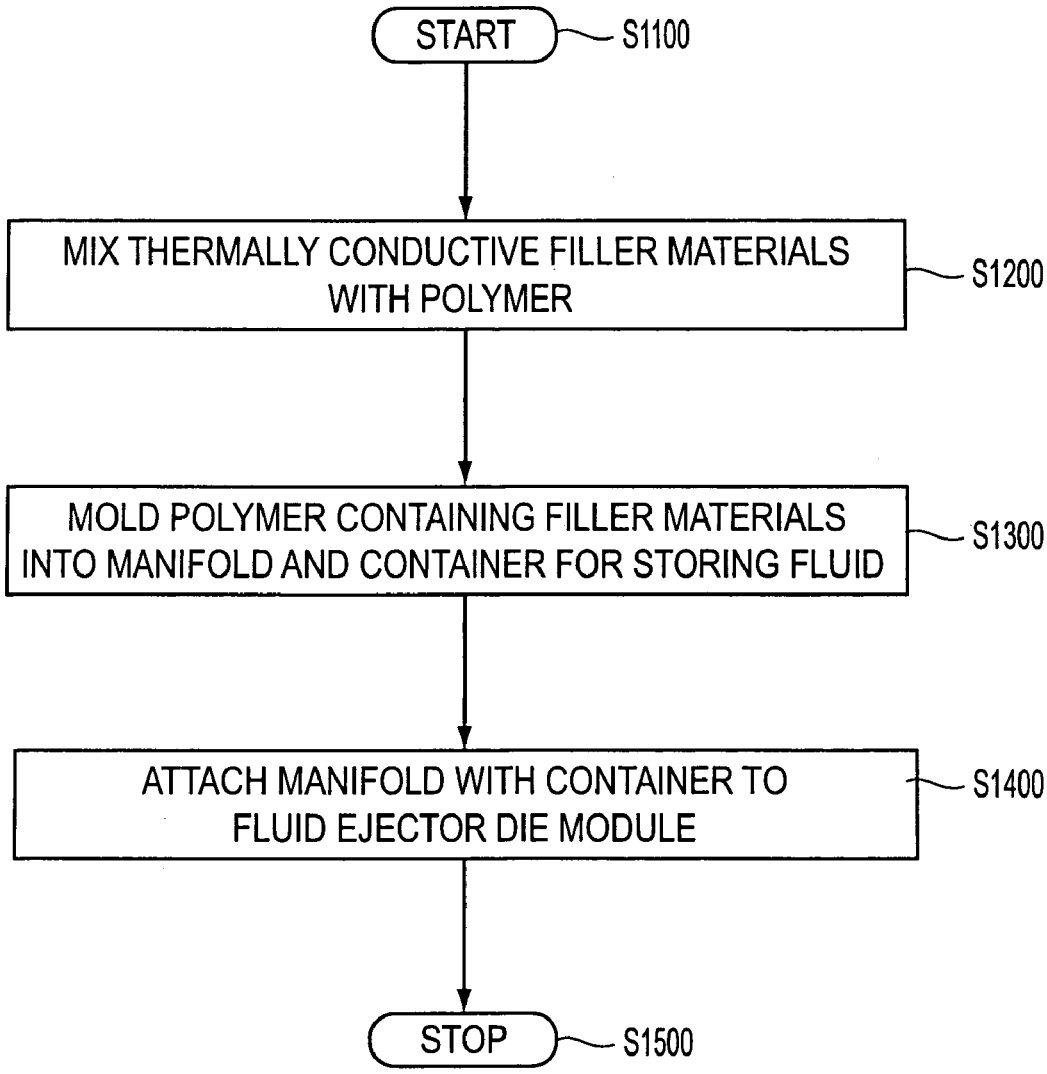
FIG. 18 is a flowchart outlining a second exemplary embodiment of a method for manufacturing a fluid ejector head having a manifold and container according to this invention.

FIG. 18 is a flowchart outlining a second exemplary embodiment of a method for manufacturing a manifold according to this invention. As shown in FIG. 18, operation of the method begins in step S1100, and continues to step S1200, where one or more thermally conductive filler materials are mixed with a polymer. Then, in step S1300, the polymer containing the one or more filler materials is molded into a manifold. The one or more filler materials may be oriented along a designed thermal flow direction. Next, in step S1400, the manifold with the container is attached to a fluid ejector die module. Finally, operation continues to step S1500, where operation of the method ends.

While this invention has been described in conjunction with the exemplary embodiments outlined above, various alternatives, modifications, variations, improvements, and/or substantial equivalents, whether known or that are or may be presently unforseen, may become apparent to those having at least ordinary skill in the art. Accordingly, the exemplary embodiments of the invention as set forth above are intended to be illustrative, not limiting. Various changes may be made without departing from the spirit and scope of the invention. Therefore, the claims as filed and as they may be amended are intended to embrace all know or later developed alternatives, modification variations, improvements, and/or substantial equivalents.

What is claimed is:

1. A fluid ejector cartridge, comprising:

a manifold that is molded from a polymer that includes at least one thermally conductive filler material; and a fluid ejector die module attached to the manifold.

2. The fluid ejector cartridge of claim 1, wherein the manifold and fluid ejector die are made of materials having similar coefficients of thermal expansion.

3. The fluid ejector cartridge of claim 1, wherein the at least one thermally conductive filler material has a thermal conductivity greater than about 10 W/m° C.

4. The fluid ejector cartridge of claim 1, wherein the at least one thermally conductive filler material has a thermal conductivity less than about 100 W/m° C.

5. The fluid ejector cartridge of claim 4, wherein the at least one thermally conductive filler material has a thermal conductivity of about 10 W/m° C. to about 100 W/m° C.

6. The fluid ejector cartridge of claim 1, wherein the at least one thermally conductive filler material is a graphite material.

7. The fluid ejector cartridge of claim 6, wherein the graphite material is formed using a petroleum pitch base material.

8. The fluid ejector cartridge of claim 1, wherein the at least one thermally conductive filler material is a ceramic material.

9. The fluid ejector cartridge of claim 8, wherein the at least one ceramic material is at least one of boron nitride and aluminum nitride.

10. The fluid ejector cartridge of claim 1, wherein the polymer is at least one of liquid crystal polymer, polyphenylene sulfide and polysulfone.

11. The fluid ejector cartridge of claim 1, wherein the polymer used to form the manifold is chemically resistant to ink.

12. The fluid ejector cartridge of claim 1, further including a container, wherein the manifold and container are integrally molded as a single piece.

13. The fluid ejector cartridge of claim 1, wherein the at least one thermally conductive filler material is oriented substantially parallel to an oriented flow area of the fluid ejector die module.

14. A method of manufacturing a fluid ejector cartridge, comprising:

at least partially molding a manifold using a polymer that includes at least one thermally conductive filler material; and attaching the manifold to a fluid ejector die.

15. The method of claim 14, wherein at least partially molding the manifold comprises completely molding the manifold from the polymer that includes the at least one thermally conductive filler material.

16. The method of claim 14, further comprising mixing at least one filler material having a thermal conductivity greater than about 10 W/m° C. into the polymer to form the polymer that includes the at least one thermally conductive filler material.

17. The method of claim 14, further comprising mixing at least one filler material having a thermal conductivity less than about 100 W/m° C. into the polymer to form the polymer that includes the at least one thermally conductive filler material.

18. The method of claim 17, wherein mixing at least one filler material comprises mixing in a filler material that has a thermal conductivity of about 10 W/m° C. to about 100 W/m° C.

19. The method of claim 14, wherein at least partially molding the manifold comprises orienting the at least one filler material substantially parallel to an oriented flow area of the fluid ejector die.

* * * * *